US005507256A

United States Patent [19]

Czadzeck

[11] Patent Number: 5,507,256

[45] Date of Patent: Apr. 16, 1996

[54] INTAKE MANIFOLD POSITIVE PRESSURE RELIEF DISK

[75] Inventor: Gerald H. Czadzeck, Bloomfield Twp., Mich.

[73] Assignee: Ford Motor Company, Dearborn, Mich.

[21] Appl. No.: 490,366

[22] Filed: Jun. 14, 1995

[51] Int. Cl.[6] ..... F02B 75/26

[52] U.S. Cl. ..... 123/184.53

[58] Field of Search ..... 123/184.53, 184.21, 123/184.54; 137/71

[56] References Cited

U.S. PATENT DOCUMENTS

| | | | |
|---|---|---|---|
| 3,029,987 | 9/1959 | Gronemeyer . | |
| 3,388,601 | 4/1965 | Ingham . | |
| 4,219,126 | 8/1980 | Oana . | |
| 4,404,982 | 9/1983 | Ou | 137/71 |
| 4,458,711 | 7/1984 | Flider | 137/71 |
| 4,473,038 | 9/1984 | Lorenzo | 123/184.53 |
| 4,951,617 | 8/1990 | Linamen et al. . | |
| 5,009,199 | 4/1991 | Macfarlane | 123/184.54 |
| 5,012,945 | 5/1991 | Keenan | 137/71 |
| 5,150,669 | 9/1992 | Rush, II et al. . | |
| 5,186,198 | 2/1993 | Kennedy . | |
| 5,197,622 | 3/1993 | Anderson . | |
| 5,253,614 | 10/1993 | Matsuo et al. | 123/184.53 |
| 5,280,769 | 1/1994 | Yates . | |
| 5,317,995 | 6/1994 | Brummer et al. . | |

*Primary Examiner*—Marguerite Macy

*Attorney, Agent, or Firm*—Donald A. Wilkinson; Roger L. May

[57] ABSTRACT

An air intake manifold assembly (20) includes an intake manifold housing (22), made of a light weight material, and a pressure relief disk (38). The pressure relief disk (38) is mounted over a relief disk hole (26) in the housing (22). The pressure relief disk (38) engages the housing (22) to form a seal during normal engine operation. Should the manifold assembly (20) experience an induction backfire, pressure relief disk (38) includes a feature (52) that will rupture at a predetermined positive pressure, thus allowing for escape of the air while minimizing the potential for damage to the housing (22) and other components on the engine that are near to the intake manifold assembly (20).

9 Claims, 2 Drawing Sheets

INTAKE MANIFOLD POSITIVE PRESSURE RELIEF DISK

FIELD OF THE INVENTION

The present invention relates to air intake manifolds used on internal combustion engine and more particularly to pressure relief disks incorporated into air intake manifold assemblies.

BACKGROUND OF THE INVENTION

Conventional air intake manifolds used on internal combustion engines in vehicles are made of cast iron or heavy wall aluminum. In order to save weight, and thus improve fuel economy, the materials that intake manifolds are being revised. For these materials to maximize the weight savings, they should use thin wall metals, such as aluminum or magnesium, and plastic, such as molded glass reinforced nylon materials. One concern, however, when designing air induction systems is the potential for induction backfires. The pressure spikes from an induction backfire can exceed 150 pounds per square inch in 10 micro-seconds, which could result in component damage to the induction system. Cast iron or heavy wall aluminum can generally absorb this pressure without permanent deformation or cracks forming. These lighter materials are generally not as robust in absorbing internal positive pressure spokes caused by an induction backfire as is the conventional steel material. Thus, the ability of these intake manifolds to sustain the internal pressure from possible sudden bursts of air due to engine back pressure, without being damaged, is significantly reduced. A possible solution is to dimension the wall thickness such that a sudden increase in positive pressure within the manifold can be absorbed without damage to the intake manifold. However, the increased weight and cost of such a design are undesirable.

Implications of failures due to backfires are non-reparable components, in which repairs will require expensive component replacement; and potential damage to surrounding components in the vehicle's engine compartment which also see the pressure spokes such as throttle bodies, air cleaners and clean air tubes.

Therefore, in order to use the new lighter materials to save weight, the need arises for a way to handle the possible back pressure without damaging the air intake manifold, which is expensive to replace. Thus, a desire exists to use thin walled, light weight materials for the manifold, in which a sudden pressure increase can be absorbed without damage to the overall intake manifold. If the lighter weight manifolds are made to generally withstand pressures from induction backfires with minimal damage and expense, then they will be economical to use.

SUMMARY OF THE INVENTION

In its embodiments, the present invention contemplates an air intake manifold assembly adapted for use with an internal combustion engine for receiving air flowing into the engine. The intake manifold assembly comprises an intake manifold housing including an outer surface enclosing an air channel and a relief disk hole through the outer surface into the air channel. The manifold housing includes a mounting lip and a mounting shoulder about the relief disk hole. The intake manifold assembly further comprises a pressure relief disk including a central plate portion and attachment means for removably and sealingly engaging the manifold housing mounting lip and the mounting shoulder. The central plate portion includes means for rupturing the central plate portion when the air in the manifold air channel reaches a predetermined positive pressure such that the air in the manifold air channel can escape from the channel through the rupture while preventing rupture when the central plate portion is subjected to negative pressure as air is flowing through the intake manifold housing.

Accordingly, an object of the present invention is to provide an air intake manifold assembly for use with an internal combustion engine wherein the intake manifold can be made of a thin walled, light weight material other than steel and can absorb an engine induction backfire without substantially destroying the intake manifold.

An advantage of the present invention is that an intake manifold assembly is configured such that a pressure relief disk is mounted to the intake manifold and is calibrated to rupture should an engine induction backfire occur in order to protect the integrity of the intake manifold, wherein the pressure relief disk is inexpensive relative to an intake manifold and can be replaced relatively easily, thus reducing the cost of repair.

A second advantage of the present invention is that the pressure relief disk can be positioned for ease of repair and also for safe discharge of relief pressure into the surrounding under-hood air space, thus minimizing potential damage to surrounding components.

DETAILED DESCRIPTION OF THE PREFERRED EMBODIMENTS

Figure 1:
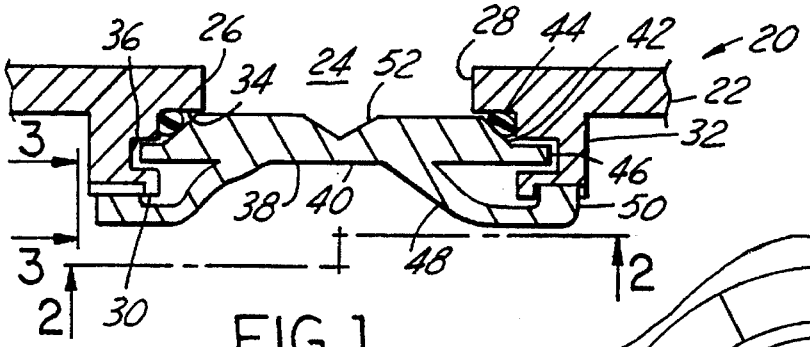
FIG. 1 is a side sectional view of a pressure relief disk shown mounted in a portion of an intake manifold assembly according to a first embodiment of the present invention.
Figure 3:
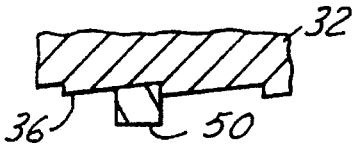
FIG. 3 is a sectional view, on an enlarged scale, taken along line 3—3 in FIG. 1.
Figure 2:
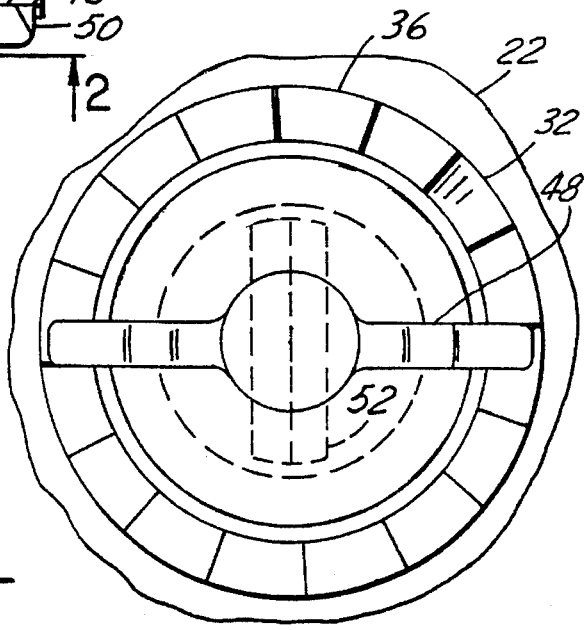
FIG. 2 is a plan view of the pressure relief disk taken along line 2—2 in FIG. 1.

FIGS. 1–3 show a portion of an air intake manifold assembly 20 for use on an internal combustion engine, like those typically used in cars and trucks. The manifold assembly 20 includes an intake manifold housing 22, that encloses an air channel 24. The housing 22 is used to contain air flowing into the engine. The manifold housing 22 is made of a thin walled aluminum, plastic, or composite material, such as nylon, rather than conventional cast iron or heavy wall aluminum.

A relief disk hole 26 is included in the manifold housing 22, the edge of which creates a mounting lip 28. Protruding form the outer surface 30 of manifold housing 22 and surrounding the relief disk hole 26 is a mounting shoulder 32. The mounting shoulder 32 is set back from the mounting lip 28 to form a seal seat 34. Further, the mounting shoulder 32 includes a surface having a series of detents 36 on it, and a cam cavity 37 around its inner periphery.

A pressure relief disk 38 is sized and shaped to mate with the mounting shoulder 32. The pressure relief disk 38 includes a central plate portion 40. The central plate portion 40 has a tapered edge 42 around its periphery that mates with the mounting shoulder 32 such that, when assembled, an O-ring seal 44 will fit between the two on the seal seat 34. The O-ring seal 44 will be under compression and the disk 38 will plug and seal the hole 26 in the housing 22. The central plate portion 40 extends out to an engagement flange 46, which engages the cam cavity 37. Notches, not shown, are included between the cam cavity 37 and detents 36 to allow the engagement flange 46 to slip into the cam cavity 36. The engagement flange 46 engages the cam cavity 37 such that when the pressure relief disk 38 is mounted to the intake manifold housing 22, the relief disk 38 can be rotated relative to the manifold housing 22 and the cam cavity 37 reduces in cross-section, pulling the relief disk 38 tightly against the O-ring seal 44.

the pressure relief disk 38 also includes a pair of ratchet arms 48, each having a ratchet finger 50 on its end. The ratchet fingers 50 engage the detents 36 when the pressure relief disk 38 is mounted to the manifold housing 22. As the two are rotated relative to one another, while the camming action takes place, the ratchet fingers 50 will engage the detents 36 and prevent reverse rotation. The ratchet arms 48 can be used by the person installing the pressure relief disk 38 to rotate it.

The pressure relief disk 38 also includes a V-notch groove 52. The V-notch groove 52 is sized and shaped to calibrate the pressure relief disk 38 so that the groove 52 will rupture when a predetermined positive pressure has been reached in the air channel 24. The V-notch 52 will provide for a high stress area in the root of the notch when subjected to air pressure from within the air channel 24. The notch will then crack if the pressure spike exceeds the predetermined pressure. As used herein, the term rupture means that a portion of the disk cracks or tears, causing some portion of the disk to split open, which allows air to escape from the air channel 24.

The pressure level calibration depends upon the amount of negative (vacuum) pressure experienced by the disk 38 during normal engine operation and the amount of positive pressure that the particular manifold housing (22), taking into account its material, can withstand without permanent damage. While the disk 38 is designed to rupture for positive pressures above a predetermined threshold, it must also withstand long term fluctuating vacuum pressures that are present in the intake manifold air channel 24 under normal operating conditions without fatigue or yield stress failures. The calibration pressure, then, is set to be low enough to protect the induction system from destruction due to induction backfires, yet strong enough to maintain its integrity under normal operating conditions.

The positioning of the relief disk hole 26 and, hence, the relief disk 38 on the manifold housing 22 is selected to allow for safe discharge of the air pressure into a surrounding under-hood air space, allowing for directional control of the escaping gas during an induction backfire event. This location can vary and is specific to the configuration of each engine and the location of its associated components within a given vehicle engine compartment.

Should an induction backfire occur, then, causing the relief disk 38 to rupture, the relief disk 38 is 100% serviceable, allowing for field repairs, in that it can be removed and replaced with another one. The ratchet fingers 50 are broken off and the relief disk 38 rotated in the reverse direction to installation and removed. A new relief disk 38 can then be installed and rotated into place. In this way, repair costs are minimized should a backfire occur.

Figure 4:
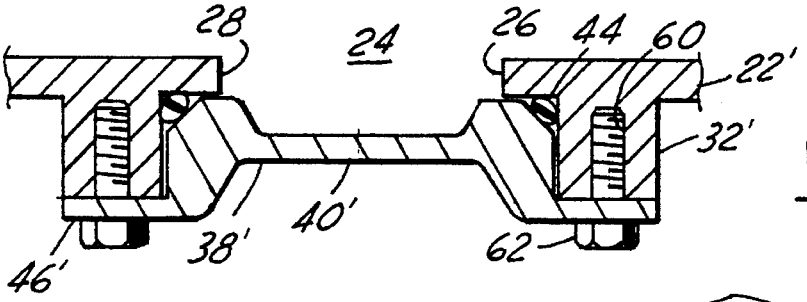
FIG. 4 is a side sectional view of a pressure relief disk shown mounted in a portion of an intake manifold assembly according to a second embodiment of the present invention.
Figure 5:
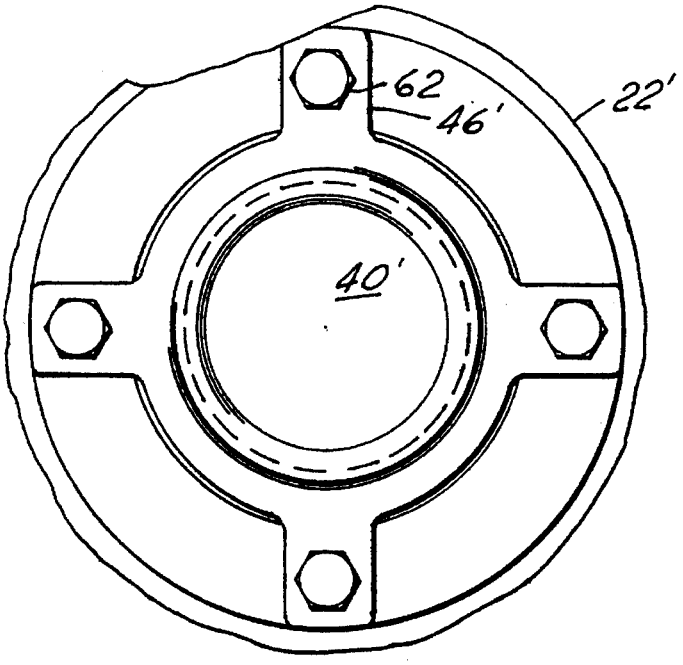
FIG. 5 is a plan view of the pressure relief disk and manifold of FIG. 4.
Figure 6:
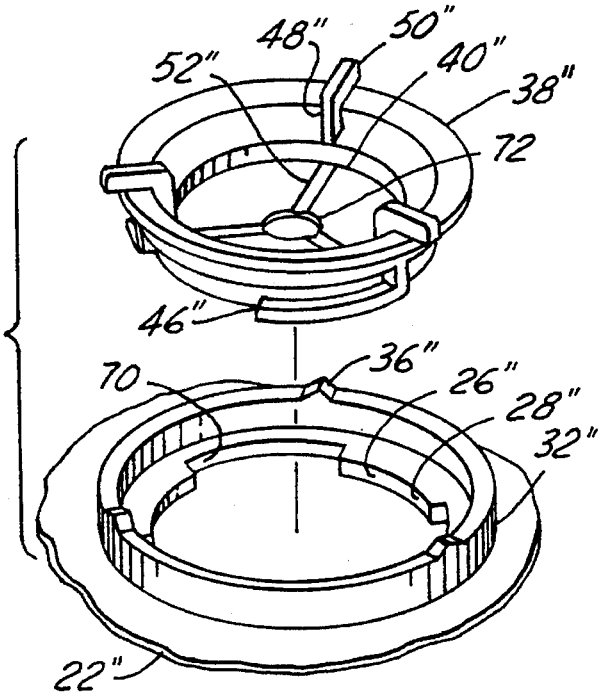
FIG. 6 is a perspective view of a third embodiment of the present invention.
Figure 7:
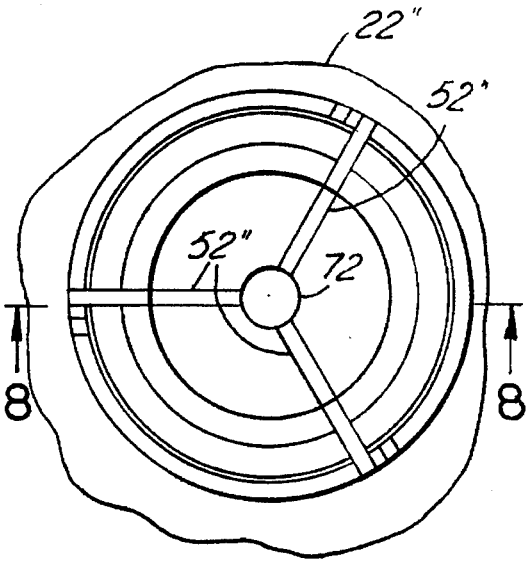
FIG. 7 is a top plan view of the embodiment shown in FIG. 6.
Figure 8:
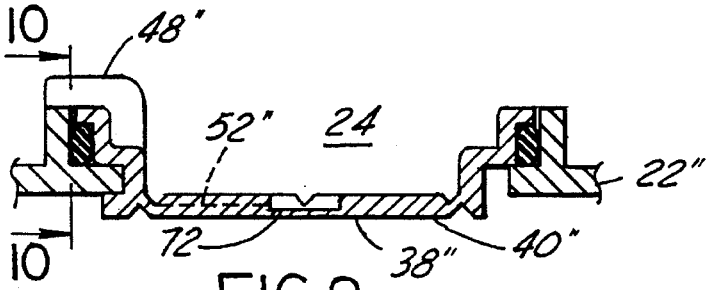
FIG. 8 is cross-sectional view taken along line 8—8 in FIG. 7.
Figure 10:
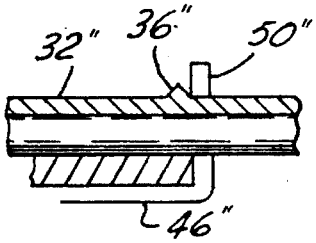
FIG. 10 is a sectional view, on an enlarged scale, taken along line 10—10 in FIG. 8.
Figure 9:
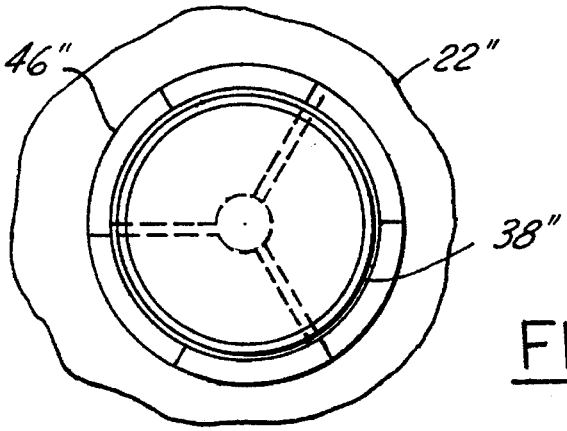
FIG. 9 is a bottom plan view, on a reduced scale, of the embodiment shown in FIG. 6.

FIGS. 4 and 5 illustrate a second embodiment of the present invention in which a different mounting configuration and a different rupture (pressure relief) mechanism are employed. In the construction shown in FIGS. 4 and 5, the elements that are essentially unchanged from FIG. 1 are referred to by the same reference numerals; the modified elements are given reference numerals with an added prime. The intake manifold housing 22' includes the relief disk hole 26 and mounting lip 28 as in the first embodiment, but the mounting shoulder 32' about the hole 26 is now configured with four threaded bolt holes 60. The pressure relief disk 38' includes an engagement flange 46' with holes through it that align with the bolt holes 60 in the mounting shoulder 32'. To mount the relief disk 38', bolts 62 are inserted into bolt holes 60 and screwed into place, compressing the O-ring seal 44 in the process.

The central plate portion 40', in this embodiment, is formed with a constant thickness thin plate cross-section. The thickness of the thin plate cross-section is calibrated to crack (rupture) when subjected to a predetermined pressure in the air channel 24.

FIGS. 6–10 illustrate a third embodiment of the present invention. In the construction shown in FIGS. 6–10, the elements that are essentially unchanged from FIG. 1 are referred to by the same reference numerals; the modified elements are given reference numerals with an added double prime. In this configuration, the mounting lip 28" of the hole 26" through the intake manifold housing 22" includes three notches 70 about its periphery. Engagement flanges 46" are sized to slip through the notches 70 when the pressure relief disk 38" is mounted on the mounting shoulder 32". The pressure relief disk 38" can then be rotated relative to the shoulder 32" by a person gripping the ratchet arms 48" and turning them so that the engagement flanges 46" engage the mounting lip 28", which also compresses the O-ring 44" through a camming action. The pressure relief disk 38" is held in place by three ratchet fingers 50" that engage three detents 36" on mounting shoulder 32".

The central plate portion 40" includes three V-notches 52" that extend radically outward from a thin disk section 72 at the center of the central plate portion 40". The cross-section of the V-notches 52" and the thin disk section 72 are sized to rupture at the predetermined pressure in the air channel that corresponds to an induction backfire, as in the first two embodiments.

While certain embodiments of the present invention have been described in detail, those familiar with the art to which this invention relates will recognize various alternative designs and embodiments for practicing the invention as defined by the following claims.

I claim:

1. An air intake manifold assembly adapted for use with an internal combustion engine for receiving air flowing into the engine, the intake manifold assembly comprising:

an intake manifold housing including an outer surface enclosing an air channel and a relief disk hole through the outer surface into the air channel, with the manifold housing including a mounting lip and a mounting shoulder about the relief disk hole;

a pressure relief disk including a central plate portion and attachment means for removably and sealingly engaging the manifold housing mounting lip and the mounting shoulder, with the central plate portion including means for rupturing the central plate portion when the air in the manifold air channel reaches a predetermined positive pressure such that the air in the manifold air channel can escape from the channel through the rupture while preventing rupture when the central plate portion is subjected to negative pressure as air is flowing through the intake manifold housing.

2. The air intake manifold assembly according to claim 1 wherein the mounting shoulder about the relief disk hole comprises a member protruding from the intake manifold housing about the mounting lip, with the member including a cam cavity around its inner periphery, and a locking surface which includes a plurality of spaced detents; and the attachment means includes a ratchet arm protruding from the pressure relief disk including ratchet fingers that mate with the detents and allow rotation in only one direction when the relief disk is mounted on the manifold housing, and engagement flanges that are retained by the cam cavity.

3. The air intake manifold assembly according to claim 2 wherein the means for rupturing the central plate portion comprises a V-notch included in the central plate portion extending radially along a surface of the central plate portion.

4. The air intake manifold assembly according to claim 1 wherein the means for rupturing the central plate portion comprises a V-notch included in the central plate portion extending radially along a surface of the central plate portion.

5. The air intake manifold assembly according to claim 1 wherein the means for rupturing the central plate portion comprises an area of the central plate portion having a thin plate cross-section.

6. The air intake manifold assembly according to claim 5 wherein the mounting lip about the relief disk hole comprises a member protruding from the intake manifold housing about the mounting lip, with the member including a plurality of fastener holes; and the attachment means includes a mounting flange affixed to the central plate portion including a plurality of holes aligned with the fastener holes and a plurality of fasteners received within the holes and the fastener holes.

7. The air intake manifold assembly according to claim 1 wherein the means for rupturing the central plate portion comprises an area of the central plate portion having a thin plate cross-section and a plurality of V-notches included in the central plate portion extending radially from the thin plate cross-section area.

8. An air intake manifold assembly adapted for use with an internal combustion engine for receiving air flowing into the engine, the intake manifold assembly comprising:

an air intake manifold housing including an outer surface enclosing an air channel and a relief disk hole through the outer surface into the air channel, with the manifold housing including a mounting lip and a mounting shoulder about the relief disk hole;

a pressure relief disk including a central plate portion and attachment means for removably and sealingly engaging the manifold housing mounting lip and the mounting shoulder, with the central plate portion including an area of thin plate cross-section sized to rupture when the air in the air channel reaches a predetermined positive pressure.

9. An air intake manifold assembly adapted for use with an internal combustion engine for receiving air flowing into the engine, the intake manifold assembly comprising:

an intake manifold housing including an outer surface enclosing an air channel and a relief disk hole through the outer surface into the air channel, with the manifold housing including a mounting lip and a mounting shoulder about the relief disk hole;

a pressure relief disk including a central circular portion and attachment means for removably and sealingly engaging the mounting lip and the mounting shoulder, with the central plate portion including a circular area of the central plate portion, having a thin plate cross-section, centered relative to the central circular portion, and a plurality of V-notches included in the central circular portion extending radially from the thin plate cross-section area.

* * * * *